US008376779B2

(12) United States Patent
Metral et al.

(10) Patent No.: US 8,376,779 B2
(45) Date of Patent: Feb. 19, 2013

(54) SHIELDING ATTACHABLE TO A CONNECTOR IN THE FIELD OF TELECOMMUNICATIONS, A COMBINATION OF A CONNECTOR AND AT LEAST ONE SHIELDING AND A METHOD OF SHIELDING A CONNECTOR

(75) Inventors: Guy Metral, Cluses (FR); Xavier Chatellard, Cluses (FR); Stefan Schoene, Bochum (DE); Mathieu Nesme, Sallanches (FR)

(73) Assignee: 3M Innovative Properties Company, St. Paul, MN (US)

( * ) Notice: Subject to any disclaimer, the term of this patent is extended or adjusted under 35 U.S.C. 154(b) by 232 days.

(21) Appl. No.: 12/680,954

(22) PCT Filed: Sep. 30, 2008

(86) PCT No.: PCT/US2008/078263

§ 371 (c)(1),
(2), (4) Date: Mar. 31, 2010

(87) PCT Pub. No.: WO2009/046003

PCT Pub. Date: Apr. 9, 2009

(65) Prior Publication Data

US 2010/0210140 A1 Aug. 19, 2010

(30) Foreign Application Priority Data

Oct. 4, 2007 (EP) ..... 07019488

(51) Int. Cl.
*H01R 9/03* (2006.01)

(52) U.S. Cl. ..... 439/607.41

(58) Field of Classification Search ..... 439/607.41, 439/607.42–607.45, 660
See application file for complete search history.

(56) References Cited

U.S. PATENT DOCUMENTS

| | | | | |
|---|---|---|---|---|
| 4,598,969 | A * | 7/1986 | Stephenson | 439/607.41 |
| 5,055,070 | A * | 10/1991 | Plegge et al. | 439/607.17 |
| 5,092,794 | A * | 3/1992 | Kachlic | 439/607.41 |
| 5,112,251 | A * | 5/1992 | Cesar | 439/607.41 |
| 5,957,720 | A | 9/1999 | Boudin | |
| 6,012,950 | A * | 1/2000 | Vanbesien | 439/607.41 |
| 6,036,543 | A * | 3/2000 | Panis et al. | 439/607.01 |
| 6,146,205 | A * | 11/2000 | Lai | 439/607.41 |
| 6,165,016 | A * | 12/2000 | Lai | 439/607.41 |
| 6,203,376 | B1 * | 3/2001 | Magajne et al. | 439/607.44 |
| 6,267,617 | B1 | 7/2001 | Nozick | |
| 6,273,756 | B1 * | 8/2001 | Ward et al. | 439/607.41 |
| 6,595,789 | B2 * | 7/2003 | Oota et al. | 439/98 |

(Continued)

FOREIGN PATENT DOCUMENTS

| | | |
|---|---|---|
| DE | 100 57 869 C1 | 8/2002 |
| EP | 0 233 397 A1 | 8/1987 |

(Continued)

*Primary Examiner* — Amy Cohen Johnson
*Assistant Examiner* — Vladimir Imas
(74) *Attorney, Agent, or Firm* — Janet A. Kling

(57) ABSTRACT

A shielding is (210) attachable at a rear side of a connector (10), with which a cable (220) having a cable shielding (218) is connectable from the rear side, and has a connector shielding (214) and at least one extension (216) connectable with the cable shielding (218) and mountable to at least two different entry portions (234) of the connector shielding (214) and/or displaceable to at least two different entry portions (234) of the connector shielding (214) along the same.

17 Claims, 10 Drawing Sheets

U.S. PATENT DOCUMENTS

| | | | | |
|---|---|---|---|---|
| 6,605,775 | B1 * | 8/2003 | Seeber et al. | 174/359 |
| 6,682,368 | B2 * | 1/2004 | Murr et al. | 439/607.28 |
| 6,709,290 | B2 * | 3/2004 | Yoshida | 439/585 |
| 6,746,277 | B2 * | 6/2004 | Laub et al. | 439/585 |
| 6,776,665 | B2 * | 8/2004 | Huang | 439/676 |
| 6,783,397 | B2 * | 8/2004 | Yang Lee | 439/607.45 |
| 6,793,515 | B1 | 9/2004 | Gwiazdowski et al. | |
| 6,811,438 | B1 * | 11/2004 | Ko | 439/607.41 |
| 6,814,615 | B2 * | 11/2004 | Laub et al. | 439/585 |
| 7,112,086 | B1 | 9/2006 | Wu | |
| 7,226,316 | B2 * | 6/2007 | Wu | 439/607.44 |
| 7,637,780 | B2 | 12/2009 | Schoene et al. | |
| 2004/0229517 | A1 | 11/2004 | Bush et al. | |
| 2006/0094281 | A1 | 5/2006 | Dang | |
| 2008/0293305 | A1 | 11/2008 | Quenneville et al. | |

FOREIGN PATENT DOCUMENTS

| | | | |
|---|---|---|---|
| EP | 0 935 314 | A2 | 8/1999 |
| EP | 1 311 022 | A1 | 5/2003 |
| EP | 0 921 603 | B1 | 2/2007 |
| JP | 2005-190691 | | 7/2005 |

* cited by examiner

SHIELDING ATTACHABLE TO A CONNECTOR IN THE FIELD OF TELECOMMUNICATIONS, A COMBINATION OF A CONNECTOR AND AT LEAST ONE SHIELDING AND A METHOD OF SHIELDING A CONNECTOR

CROSS REFERENCE TO RELATED APPLICATIONS

This application is a national stage filing under 35 U.S.C. 371 of PCT/US2008/078263, filed Sep. 30, 2008, which claims priority to European Application No. 07019488.1, filed Oct. 4, 2007, the disclosure of which is incorporated by reference in its/their entirety herein.

TECHNICAL FIELD

The invention relates to a shielding attachable to a connector in the field of telecommunications providing an increased versatility regarding the connection of wires to the connector while shielding them. The invention further relates to a combination of a connector and at least one such shielding as well as a method of shielding a connector.

BACKGROUND

In the field of telecommunications, and in the field of data transmission and processing, numerous connections are established by telecommunications and/or data lines. These connections can be made by wires, for example copper wires.

Plural wires can be integrated with a cable and can be put together at a connector, such as a plug or a socket. By connecting two connectors of this type with each other, plural connections between the wires, which are connected with each of the connectors, are established. Such a type of connection can also be used in networks, such as local area networks, for any connections between devices being part of the network. Such a network may have an outlet in a work area and a patch panel in a data room. Connectors may be mounted in the outlets and/or the patch panels. Typical connectors are described in ICE 60603-7.

In the field of telecommunications and data transmission recent advances in ADSL-technology allow transmission of at least two different signals on a single telecommunications line. This is achieved by transmitting the different signals at different frequencies along the same line. In particular, on the subscriber side, separate voice and data signals are combined and sent to the central office via the same transmission line where it may be split. The voice signal is then directed to the other subscriber(s) on the telephone call, and the data signal is directed to the other subscriber(s) participating in the data exchange. For the transmission of voice and data signals to the subscriber, separate voice and data signals are combined at the central office, sent to the subscriber and split at the subscriber side.

Particularly in connection with ADSL technology, the rates at which telecommunications and data signals are transmitted by telecommunications modules have increased remarkably resulting in increased cross-talk effects. The term "cross-talk" describes an effect in which the contacts of a telecommunications module act as small antennae, which transmit an interfering signal to adjacent contacts. Generally, the interfering signals are transmitted by a pair of wires and, therefore, by a pair of adjacent contacts. Thus, cross-talk between the contacts of a single pair is not an issue. However, cross-talk between the contacts of adjacent pairs should be reduced as far as possible.

The contacts in conventional jack connectors may be in close proximity to one another. If these jack connectors are used in high performance communication systems, cross talk between adjacent conductor pairs may occur. As regards crosstalk between pairs of wires, such crosstalk is reduced by twisting the pairs. Moreover, plural twisted pairs, which may be integrated in a cable, may be shielded from each other and/or twisted themselves. The shielding of an individual wire pair may be formed by a foil shielding, in other words, a metal foil or metalized foil formed around a twisted pair. As an alternative, individual pairs may be shielded by a braid. Finally, crosstalk between adjacent cables may be reduced by shielding the cables. In this context, the shielding of individual wire pairs may be formed as a foil shielding, and the shielding of the cable may be formed by a braid. Moreover, the cable may additionally have a drain wire. Moreover, the connector including an area, where a cable enters the connector, may be shielded to substantially avoid influence by external electric fields.

DE 100 57 869 C1 is related to a connector having a metal housing shielding the connector. At least one part of the housing may comprise a trough-like structure to contact an exposed shielding of a cable connected with the connector.

EP 0 921 603 B1 is related to a connector having a rear metal cover with a flexible metal tube, through which a cable may be inserted so that the metal tube contacts the exposed shielding of the cable.

EP 0 935 314 A1 discloses a connector with a rear metal cover. The cover provides openings through which a cable may be inserted. Inserts may be used to close the openings. As inserts are disclosed are plug like inserts or couplings or fittings for leading a cable through the metal cover.

SUMMARY OF THE INVENTION

The invention provides a shielding attachable to a connector in the field of telecommunications which leads to an improved versatility of the connector regarding the connection of wires while shielding same. Moreover, the invention provides a combination of a connector and at least one such shielding as well as a method of shielding a connector.

BRIEF DESCRIPTION OF THE DRAWINGS

The invention will be described hereinafter in part by non-limiting examples thereof and with reference to the drawings, in which.

DETAILED DESCRIPTION OF PREFERRED EMBODIMENTS

Figure 1:
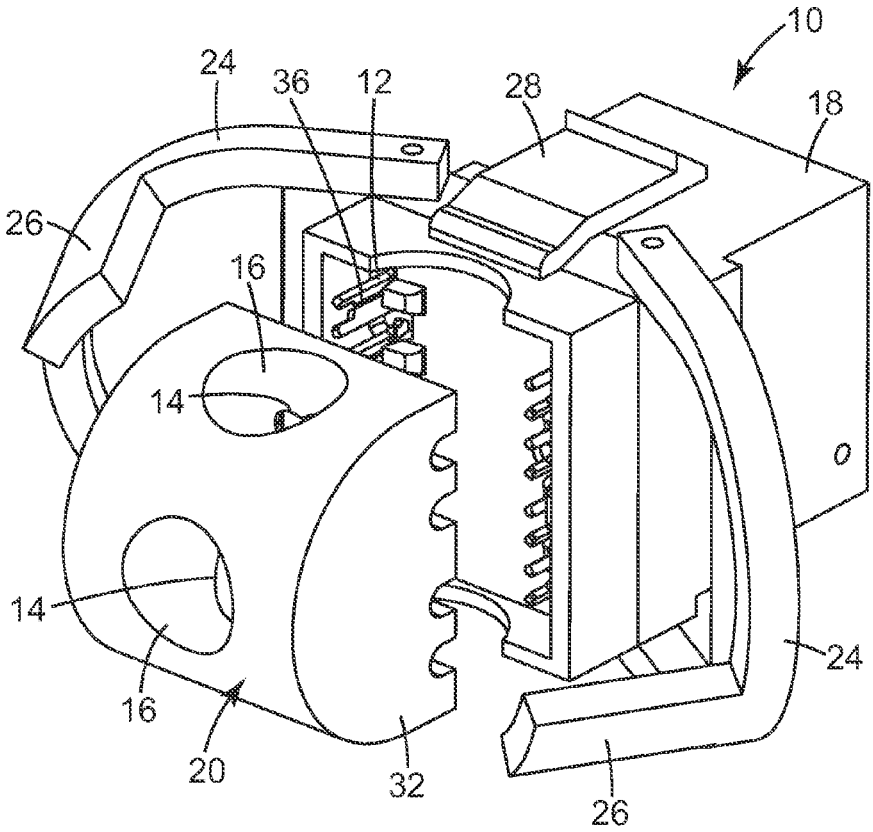
FIG. 1 shows a perspective rear view of a connector according to the invention, partly dissembled.

The shieldings described herein are attachable at a rear side of a connector. As used herein, the term "front side" denotes that side of a connector, at which a complementary connector is connectable, for example, by being inserted. The opposite side is denoted by "rear side". The shieldings described herein are attachable at a rear side. However, they may extend to one or more of the top, bottom and one or both side faces. Thus, the shieldings described herein may provide shielding for one or more of the mentioned sides of the connector. Attaching the shielding to a connector may be accomplished in any suitable manner, for example, by one or more projections engaging with one or more recesses in the connector, and/or one or more recesses or holes, with which one or more projections, latch hooks or similar structures of the connector engage. In a corresponding manner, the shielding may have such structures. The shielding may also be described to be "clipped" to a connector. Moreover, any of the above-described measures to allow attachment of a shielding may also be provided on a guide piece of the connector as described below. Also, the shielding may be a part, preferably an integral or integrated part, of the connector.

A cable having a cable shielding may be connectable with the connector from the rear side. In this context, this connection does not necessarily have to be performed exactly from the rear side. Rather, it is conceivable that the cable enters the connector at the rear thereof, however, at least to some extent from the top, bottom or one of the lateral sides. Thus, any connection of a cable in an area opposite the front side of the connector, i.e. in the area different from the area adapted to accommodate a complementary connector, may be used for connecting a cable with the connector.

The shieldings described herein have a connector shielding which may constitute a main body portion of the shielding and may be adapted to shield one or more of the rear, top, bottom and one or both of the lateral sides. In this manner, the connector, as such, may be shielded. In order to continue the shielding towards the cable and to connect any shielding, including the cable's shielding with each other to connect them with the ground together, the shielding has one or more extensions connectable with the cable shielding. The cable shielding may, for example, be made of a braid. The extension adapted to be connected with the cable shielding may be formed in any suitable manner, as described in detail below.

The at least one extension is, in a first alternative, mountable to at least two different entry portions of the connector shielding. In other words, the connector shielding has two or more entry portions for accommodating a cable. The connector's versatility, while maintaining a shielding, is increased by at least one extension mountable to the at least two different entry portions. Thus, where it is intended to insert a cable into the connector through the shielding, the extension can be provided at the appropriate location and can make contact between the cable shielding and the connector shielding. Thus, ground continuity between the connector and the cable may advantageously be kept. The mountability of the at least one extension may, for example, be realized by engaging portions, such as one or more projections or latch hooks with complementary structures at the connector shielding. Moreover, the extension may have one or more bendable portions adapted to be bent around an edge of the connector shielding.

In a second alternative, the extension may be mountable or pre-mounted to the connector shielding in a way to render the extension displaceable to at least two different entry portions of the connector shielding along the same. Thus, the extension may be displaced along the connector shielding to the desired point of entry of a cable. Thus, in an easy and versatile manner, the shielding may be adjusted to the specific needs and shielding can be realized. In this context, at least one extension may be slidable along the connector shielding. Moreover, at least one extension may have one or more flexible, bendable or similar portions so that at least these portions of the extension, possibly also the extension as a whole, may be displaceable towards two different entry portions by bending or deforming the mentioned flexible portions. In this case, the extension may be mounted at a fixed location of the connector shielding and may be adjustable to at least two different entry portions by the above-described deformation.

As a further alternative, the shielding may originally have more extensions than are needed in use, so that the shielding can readily be adjusted to the specific needs by removing the unnecessary extensions. When additional openings for inserting a cable are provided near each extension, the extension could be used to "close" the opening to substantially complete the connector shielding.

At least one such entry portion has at least one breakout portion, in other words a section of the connector shielding, which may be removed to allow a cable to be inserted. The breakout portion may, for example, be defined by a predetermined breaking point and/or a portion which is partially separated from the connector shielding and, for example, connected via small webs or ridges which are easily breakable. In this context, one or more breakout portions may be adapted to form one or more extensions. In other words, the extension may form a part of the connector shielding in a first state and may, for example, be bent from the connector shielding to constitute an extension adapted to contact a cable shielding. In this case, the shielding described herein may be provided as a single component, with which both the connector shielding and the one or more extensions are made in one piece. Moreover, also projections, clips or similar structures which serve to allow the shielding to be mounted to a connector, may be provided integrally, i.e. in one piece.

Both in an embodiment, where the extension is mountable to the connector shielding, and an embodiment, in which the extension is displaceable along the connector shielding, at least one extension may be bent around at least one edge of the connector shielding. The bent portion may provide a type of guide for moving the extension along the connector shielding by accommodating at least one edge of the connector shielding. Those openings, where the at least one extension can be mounted or moved to contact the shielding of a cable inserted through the opening, may be formed in entry portions.

The shieldings may have two entry portions arranged asymmetrically. In this case, one entry portion may be provided substantially at the centre of the shielding and may correspond with an approximately centred opening for accommodating a cable, the opening being formed in the connector and described in more detail hereinafter. The second entry portion may be formed eccentric, and the shielding can thus be described to be asymmetric. When any structures for mounting the shielding to a connector are maintained for different orientations, which may mean that the shielding is symmetric apart from the position of the second entry portion, the shielding may be turned substantially about the centre entry portion so as to bring the second entry portion to the opposite position and thus allow a cable to be inserted from three different directions. However, the shielding may also have three or more entry portions.

In the shieldings described herein at least one extension may include a ring or ring segment. A ring or ring segment may be well adapted to make contact with a substantially circular shielding of the cable. It is noted that a complete ring may be provided on at least one extension.

With one or more extensions having a ring or ring segment, preliminary ring segments may form a ring having interruptions. In this manner, the cable shielding may be contacted substantially along the entire circumference to make particularly good contact. Moreover, the substantially complete ring is integral with one or more extensions which may be integral with an extension piece or even the shielding itself. In other words, contact between the cable shielding and the shielding described herein may be made with a single component having a uniform impedance which is beneficial from the viewpoint of connecting any current induced in the shielding to ground. In particular, when more than one extension are present, these may advantageously have the same impedance.

It may be advantageous to provide at least one extension and/or at least one ring or ring segment with at least one web formed across the extension or along the ring or ring segment, respectively. The web, which may also be called a ridge or annular protrusion, may advantageously be used to position and/or guide a tie, particular a cable tie, a tape, a string or any other part which may be used to tie the one or more extensions, ring segments or a ring around a cable shielding.

It may also be beneficial to render at least one extension resilient with regard to the connector shielding. In this case, one or more extensions may, in a first state, be spaced apart in a manner sufficient for a cable to be inserted between the extensions. When the cable has been inserted, and the extensions are to be tied around the cable shielding, their resiliency may be used to move them towards the cable shielding.

It may be advantageous if the connector shielding has at least one, preferably plural engagement portions, and at least one extension has at least one engagement member adapted to block displacement of the extension in at least one direction. In this manner, the mentioned engagement portion and engagement member may be adapted to allow displacement of at least one extension towards an entry portion of the connector shielding, and may be blocked from moving away from the entry portion. Thus, appropriate positioning of the one or more extensions may be provided. The engagement portions may be formed as a type of railway having one or more recesses and/or projections. The at least one engagement member of the extension may be adapted to interact with the engagement portions in the above-described manner. In this context, the engagement member may be releasable, e.g. by lifting same with a finger from the engagement portions of the connector shielding to allow the extension to be moved in the direction which is blocked by the engagement member. The shieldings described herein may particularly have two displaceable extensions, each having substantially a half ring segment, so that the two extensions may be displaced to each other so as to surround an entry portion. When a cable is inserted through the entry portion, the shielding thereof may be surrounded substantially 360 degrees by the cooperation of the described half ring segments.

It is noted that the present specification discloses a one-piece shielding having an integral ring or plural integral ring segments which may be used to both make electrical contact with a cable shielding and clamp the same to provide pull relief. Such a shielding having one or more of the features described above and below, but not necessarily the feature of the at least one extension mountable to at least two different entry portions or being displaceable to at least two different entry portions, is to be considered subject matter of the present disclosure.

As indicated above, the shieldings described herein provide increased versatility to a connector in the field of telecommunications, to which the shielding is attachable. Consequently, the invention also provides a combination of a connector and at least one shielding having one or more of the features described above and below.

In this context, it may be advantageous to further provide at least one cable tie to tie one or more extensions, ring segments or a substantially complete ring to a cable shielding of a cable which has been inserted into the connector.

The connectors described herein have contacts with which wires are connectable. The wires may be connectable with the contacts "inside" the connector, i.e. the interfaces between the wires and the connectors may, during use of the connector, be fully "hidden" and/or fully surrounded by parts of the connector's housing. Those portions of the contacts, where wires are connectable, may, for example, be formed as insulation displacement contacts, as wire wrap contacts or in any other suitable manner. The contacts may have portions exposed outside the connector, so that a complementary connector also having contacts is connectable with the connector such that the contacts of the connectors are in electrical contact. By way of example, the connector described herein may be a RJ45 type connector or a connector in line with ICE 60603-7.

The wires, which are connectable with the contacts of the connector, may be integrated with a cable and the connector described herein may have at least three wire openings for inserting at least two wires through each opening. The wire openings may, for example, be adapted to accommodate two wires, i.e. a pair of wires, which may be twisted, four wires, i.e. the two pairs, or more wires. Moreover, at least one wire opening may be adapted to accommodate a cable, with which the wires are integrated. A cable may, for example, have four twisted wire pairs integrated therewith. The wire pairs may be shielded from each other, and a shielding as well as an electrical insulation may be provided around the wire pairs. The connectors described herein may be advantageous in that the "complete" cable may be inserted through a wire opening and guided in a suitable cable guide. A "complete" cable may have plural twisted wire pairs, for example, four wire pairs, shielding for the individual pairs and/or the cable shielding around all pairs, possibly a drain wire and, for example, as the outermost layer, an insulation. When a wire opening is adapted to accommodate a "complete" cable, it can substantially be ruled out that the shielding and electrical insulation needs to be removed from the cable until the location, where the wires are separated from each other to individually connect them with contacts. In this context, it is noted that cables, as described above, may be formed "substantially balanced" by providing twisted wire pairs, twisting the twisted pairs themselves and providing appropriate shielding. This substantially balanced state is disturbed when the individual pairs, or even wires, are separated from each other. In other words, the desired, substantially balanced state may substantially be maintained if the wire openings are adapted to accommodate a "complete" cable. These effects may be supported by an appropriate arrangement of the contacts of the connector, which allow guiding the wires to the individual contacts with as few crossings of twisted wire pairs as possible.

One or more wire openings may be adapted to allow the insertion of fewer wires then wires integrated with a cable. The wire openings, which may, for example, be smaller in cross-section than the cable, may then allow to remove the insulation and shielding of cable and the separation of wires or wire pairs from each other at a defined location. In certain applications it has been found that it would have drawbacks to insert the cable including insulation and shielding too far into the connector and towards the contacts. There is, for example, a certain risk of a short-circuit when a cable shielding gets into electrical contact with the contacts of the connector. Thus, in these cases, insulation and shielding of a cable may be removed at the end of the cable for a certain distance, and the wires or wire pairs may be separated from each other and inserted into the connector, through the one or more wire openings, individually. In this situation, a wire pair, possibly together with its individual shielding, such as a foil shielding may be inserted into the connector through the one or more openings. This may be advantageous as the twisted wire pair may maintain the twisted state and may also be guided in this state, which may be beneficial from the viewpoint of shielding.

The wire openings may be exposed on an outside of the connector distal from the contacts. The wire openings can also be said to be exposed to a side where an incoming cable is to be connected with the connector. This side may be described to be generally opposite a side where a complementary connector is to be inserted. Thus, the wire openings exposed on the outside of the connector may be described to be remote or distal from the contacts. As mentioned, any connections between individual wires and the contacts may be formed within the connector.

The wire openings may be formed by a relatively simple opening, through hole or bore that serves to allow the insertion of wires or the cable in a certain direction at that point, where the opening, through hole or bore is formed.

The advantageous effect of increased versatility is supported by the aspect that the wire openings are orientated in at least three different directions. Firstly, the wire openings are exposed on the outside of the connector. Thus, a cable or wire may be inserted into an appropriate opening from outside the connector. In this context, it may be advantageous to provide openings being orientated in at least three directions to allow cables coming from at least three different directions, to be safely and reliably connected with the connector. Due to the orientation of the at least three openings, the appropriate one, i.e. the one being orientated with the most "coincidence" with the direction of the wire or cable, may be chosen to insert the wire or cable. In particular, cables arriving from underneath the floor, under a ceiling, in ducts or from behind panels, may advantageously be inserted into the connector with their orientation being substantially maintained up to a position inside the connector. This may minimize the occurrence of undesired bendings of the cable, which is particularly advantageous when insulation and/or shielding have been removed from the cable. This is because in this state, i.e. with insulation and/or shielding removed, the desired arrangement of the wires may be difficult to maintain.

The at least three openings may, for example, be exposed in different radial directions from a center region of the connector or a location where it is intended to disintegrate the wires of the cable and separate individual wires from each other.

Thus, disadvantageous curvatures at the location of entry into the connector may substantially be avoided. Moreover, the wires or the complete cable may be guided particularly close to the contacts, the wires may be separated from each other there and the connections with the contacts may be made relatively close to this location. In particular, any unavoidable bending, to bring the wires into a proper orientation relative to the contacts, may be done in a controlled manner, such as within the connector and by providing a defined orientation of recesses guiding the individual wires (described in more detail below) and other guides. In particular, the complete cable may not have to be bent at all. Rather, the necessary bending of the wires may be done at that point, where the wires are separated from each other. For example, the unavoidable bendings of the wires may be as close as possible to the contacts of the connector.

Thus, reliable connections can be made between the contacts and the wires, the twisting of the wire pairs and the separation between wire pairs can be maintained up to a location very close to the contacts, and the shielding of the cable may be kept up to this point. Thus, the occurrence of crosstalk may be minimized. Moreover, the well defined positioning of the individual wires and the substantial minimization of disarrangements and misalignments of wires secures the transmission performance of the wires.

The connector described herein may be mounted on printed circuit boards. Also in such a case, a cable may be connected with the connector as described above. As an alternative, or in addition to such a cable, a cable could be connected with conductors printed on the printed circuit board and connected with contacts of the connector. The printed circuit boards may be provided in active network equipment such as routers. Moreover, the connectors may be mounted on patch panels and outlets that may be provided in walls or cable ducts.

The wire openings may be arranged in pairs or groups of four, the openings of one pair or group being exposed in the same direction. The group of openings may be adapted to allow the insertion of all wires of a cable through the openings of a single group. Thus, substantially all wires of a cable, arriving at the connector with a particular orientation, may substantially keep this orientation through the openings and up to a location inside the connector. This also applies when one or more openings are adapted to accommodate a "complete" cable. Also in this case, the cable may arrive from any one of at least three different directions and may advantageously not have to be bent at the point of entry into the connector. Moreover, when the openings are arranged in pairs or groups of four, each opening may, for example, be adapted to accommodate half or a quarter of the number of wires which are present in a cable. For example, in a cable having eight wires, i.e. four pairs, four wires, i.e. two pairs can be inserted into each opening of a pair of openings. When a group of four openings is present, two wires, i.e. one pair, may be inserted into each opening of a group of four openings. With such a structure, the wires may advantageously be kept spaced from each other already at their point of entry into the connector. In this manner, crosstalk may be minimized.

A guide may be formed adjacent at least one wire opening and may have a certain extension in the direction of the wire or cable to be guided, to define the direction and shape of the wire or cable substantially throughout the extension of the guide. Thus, the guide may extend substantially straight, curved or angled. Wherever curves and/or angles are present, when the guide is adapted to guide the complete cable, the cable is advantageously bent as a complete cable, so that misalignments of the individual wires are unlikely, so that deterioration of the transmission performance and of the crosstalk properties may be minimized. The wire or cable guide may be formed by structures, such as partitions, webs and/or lugs adapted to keep individual wires or groups of wires apart from each other. Moreover, channels, which may have a closed cross-section, may be formed in the connector to guide individual wires or groups of wires to those contacts with which they are to be connected. In addition to wire or cable guides, or alternatively, the connector may have a colour coding to assist the person connecting wires with the connector in making the correct connections.

At least one guide may be adapted to accommodate a cable with which all wires connectable with the contacts of the connector are integrated. Thus, a "complete" cable may be guided by the guide and the possibility of misarranging individual wires is particularly low. However, as indicated above, it may also be advantageous to adapt at least one guide to accommodate fewer wires, such as a single wire pair.

It may be advantageous to provide the connector with a housing and at least one guide piece. At least one wire opening may be formed in the guide piece. With these separated components, both the housing and the guide piece may be designed with a specific focus on the functionality of the component. For example, the housing may be designed to accommodate the contacts, the guide piece and, for example, any structures, such as latch hooks, screw openings or similar structures which allow the connector to be mounted to a patch panel, an outlet or similar surrounding as described above. Moreover, the guide piece may have wire or cable guides as mentioned above with any suitable structure, including those exemplary structures mentioned above.

The guide piece may be adapted to be moved towards the contacts to connect the wires with the contacts. This movement and the resulting connection of wires may be effected manually so that there may be no need to provide and use specific tools.

The guide piece may not only have openings and adjacent guides but also at least one recess for accommodating at least one individual wire. The recess may be facing the contacts so that an individual wire may be accommodated in a manner to support its connection with a contact. The recesses that are adapted to guide individual wires may be formed of any other suitable structures for guiding individual wires, such as ribs or channels.

The contacts may be formed as insulation displacement contacts having a contact slit, into which the wire is pushed to cut the insulation of the wire and allow the legs defining the contact slit to contact the metal part of the wire. When the wires are accommodated in recesses, as described above, it has been found advantageous to push the wires into the contact slits in this accommodated position. In this connection, it may be advantageous to provide at least one slot for accommodating at least one contact in the guide piece. Moreover, the one or more slots may be used, together with the contacts accommodated therein, to guide the guide piece when it is moved towards the contacts. However, alternatively or in addition, further guiding elements may be provided on the connector to guide the movement of the guide piece.

Moreover, the above-described step of pushing the wire into the contact slit while accommodated in the recess, may be performed readily when at least one slot and at least one recess intersect each other.

As indicated above, the guide piece may be adapted to be moved towards the contact to push the wires into the contacts. Thus, it may be advantageous to provide the housing with at least one drive piece adapted to drive the guide piece to the contacts. Such a drive piece may assist the operator connecting the wires with the contacts in establishing the connections.

It may be particularly advantageous to form at least one drive piece as a pivotable flap having at least one projection adapted to drive the guide piece when the flap is pivoted. This allows an especially easy actuation of the drive piece to move the guide piece towards the contact. Moreover, through the action of the projection, a lever effect may be used.

It has been found in tests with the connector described herein that the guide piece can be moved towards the contacts relatively easily, when two projections are provided. Two projections may, moreover, be provided in a manner to locate at least one wire opening between two projections. Thus, an easy actuation of the guide piece may be combined with a ready access to the wire openings.

It is also possible that the drive piece functions as a shielding. For shielding applications, the drive piece can comprise an electrically conductive material, e.g. an aluminum based material or any other suitable electrically conductive material. Furthermore the drive piece may cover almost the complete rear side of the connector if it functions as a shielding. Such an embodiment where the drive piece would fulfill two different functions—driving the guide piece and shielding the connector—would have the advantage that less parts would be necessary for the assembly of the connector.

Whereas the connectors described herein may be provided as plugs or male connectors, preferred embodiments of connectors may be formed as jacks or sockets, i.e. female connectors.

In a method of shielding a connector described herein, a shielding having one or more of the features described above is prepared. In this context, at least one extension may be mounted to a connector shielding, and/or be displaced to a desired position along the connector shielding. Moreover, any of the above indicated method steps, such as bending a part of an extension around an edge of the connector shielding, and/or removing a breakout portion and/or bending at least one extension from the shielding, as well as any further method steps indicated above, may be preformed. In a subsequent step, a cable is inserted through the shielding in the vicinity of at least one extension. The wires of the cable may then be connected with contacts of the connector. Thereafter, the shielding may be attached to the connector, and at least one extension may be connected with the cable shielding.

In this context, the step of connecting the at least one extension with the cable shielding may involve moving the extension towards the cable shielding. This may, for example, serve to bring one or more ring segments into tight contact with the cable shielding.

To ensure this contact and/or clamp the cable, a tie, for example a cable tie, a tape, a string or a similar part, may be tied around the at least one extension, the one or more ring sections or the complete ring. Moreover, one or more extensions may have structures which allow them to be hooked or otherwise connected to each other. For example, one or more ledges may be present.

Turning now to FIG. 1, which is a perspective rear view (i.e. from the side where the cable enters the connector 10) of the connector 10, partly disassembled. The side, where a cable (not shown) is inserted into the connector 10, for example through an opening 16, is facing the viewer of FIG. 1. Therefore, the generally opposite side, where a complementary connector may be inserted, is not visible in FIG. 1. However, as will be readily apparent to those skilled in the art, a housing 18 of the connector 10 may define a generally rectangular opening, within which contacts are exposed to allow the contacts of a complementary connector (not shown) to be electrically contacted. The housing 18 may be provided with latch hooks 28 or similar structures to allow mounting the connector 10 to an appropriate surrounding. This may, for example, be performed by attaching the connector 10 to a panel from the rear side, so that the latch hook visible in FIG. 1 will protrude to the front side. When the panel has two substantially parallel walls, the latch hook protruding through the rear wall may be hidden behind a front wall.

Inside the connector 10, those portions of the contacts 12, where wires (not shown) are connectable, are shown. These portions may be formed as insulation displacement contacts. A guide piece 20 having, in the embodiment shown, three openings 16 with adjacent guides 14 (one of them being formed on the underside and not visible in FIG. 1) may be moveable towards the contacts 12. As described in more detail below with reference to FIG. 2, a cable having a plurality of wires, with shielding and insulation around all the wires, may be inserted into either one of the cable guides 14 through the respective opening 16 visible in the figure. In the embodiment shown, the guide piece 20 is formed as a type of semi-cylinder with recesses 22 (see FIG. 2) adapted to accommodate individual wires being formed on the flat face and wire openings 16 being formed at three different positions along the curved face.

The connector shown in FIG. 1 has two drive pieces in the form of pivotable flaps 24, each having a projection 26. When a cable has been inserted through cable guide 14, and the individual wires have been accommodated in the recesses 22 (see FIG. 2), the guide piece 20 may be placed in close proximity to the contacts 12, the pivotable flaps 24 may be pivoted towards the guide piece 20, and the projections 26 may be engaged the guide piece 20 to push it towards the contacts 12 when the pivotable flaps 24 are approaching their final position shown in FIG. 3. Generally, the pivotable flaps 24 may be pivotable about an axis perpendicular to the direction in which the guide piece 20 is to be moved.

Figure 2:
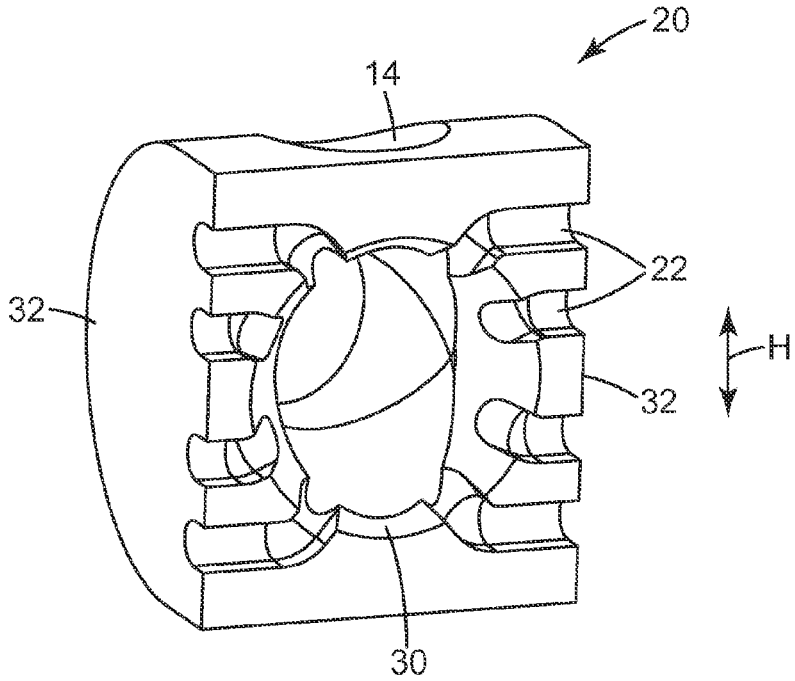
FIG. 2 shows a perspective view of a guide piece of the connector of FIG. 1.

As can be seen in FIG. 1, the cable guides 14 may have a certain extension from the semi-cylindrical surface visible in FIG. 1 towards the inside of the guide piece 20 visible in FIG. 2. In other words, the guides 14 may have a substantially cylindrical inner wall, by which the cable may be guided. Moreover, the guide piece 20 shown in FIG. 1 may additionally have openings formed at one or both (semi-circular) side faces, i.e. those faces directed to the pivotable flaps 24. Moreover, one or both pivotable flaps 24 may be formed with suitable openings to allow access to the above-described laterally open wire openings, which are not shown in FIG. 1. With this modification, the cable to be connected with the connector 10 may not only arrive at the connector 10 from the rear side, the top and the bottom, as seen in FIG. 1, but also from one or both of the lateral sides.

FIG. 2 shows the guide piece 20 of FIG. 1 from the side facing the contacts 12 (see FIG. 1). As can be seen from FIG. 2, the cable guides 14 each terminate at approximately the same position inside the guide piece 20. At that location, the cable's insulation and shielding usually ends. In other words, when the wires of the cable are to be connected with the contacts 12 of the connector 10, the cable is inserted through the appropriate guide 14, and the insulation and shielding are removed and the end of the cable to expose the individual wires. The cable may then be arranged to allow the individual wires to be accommodated in recesses 22 visible in FIG. 2. Thus, the insulation and shielding of the cable may terminate approximately at the position of the central opening 30, to which the recesses 22 extend.

As can be seen from FIG. 2, in the embodiment shown, the recesses 22 each have a first portion, extending from the opening 30, which extends approximately radially from the opening 30. In other words, the first portions together have a somewhat star-like appearance. Second portions of the recesses 22 extend approximately parallel to each other. In the embodiment shown, the second portions of those recesses which are on different sides of the opening 30, but at approximately the same height along the height direction H, may be aligned with each other. However, the recesses 22 could also be arranged on a single side of the opening 30. When the wires of the cable are to be connected with the contacts 12, individual wires are separated from each other to also accommodate a somewhat star-like or radially extending appearance, and the individual wires are accommodated in the recesses 22. It is noted in this context that the recesses 22 may have one or more flexible parts, portions and/or adaptors, to generally adapt their size to different sizes of wires. For example, one or more recesses 22, may have one or more "half-pipes" having an onion-type structure and suitable to remove as many "layers" as necessary to make the recess large enough for accommodating a particular wire. Such flexible and/or removable parts may be made of rubber. The above-mentioned measures to adapt the recesses 22 to different sizes of wires, is also applicable to other types of recesses, such as recesses 122 shown in FIG. 4 and described in more detail below.

After possibly removing the necessary parts of the recesses 22 and accommodating the wires therein, as described above with reference to FIG. 1, the guide piece 20 is moved towards the contacts 12, so that each wire is pushed into a contact slit 36 of a contact 12. To allow this pushing of a wire accommodated in a recess 22 into the slit of contact 12, the guide piece 20 has, on the surface facing the viewer of FIG. 2, a plurality of slots (not shown) for accommodating the contacts 12. The slots may intersect with the recesses 22. In an alternative embodiment, the guide piece 20 may be adapted to fit between contacts 12 aligned along the lateral sides 32 of the guide piece 20 so that wires accommodated in the recesses 22 will also be pushed into the contacts 12 positioned as described above.

Figure 3:
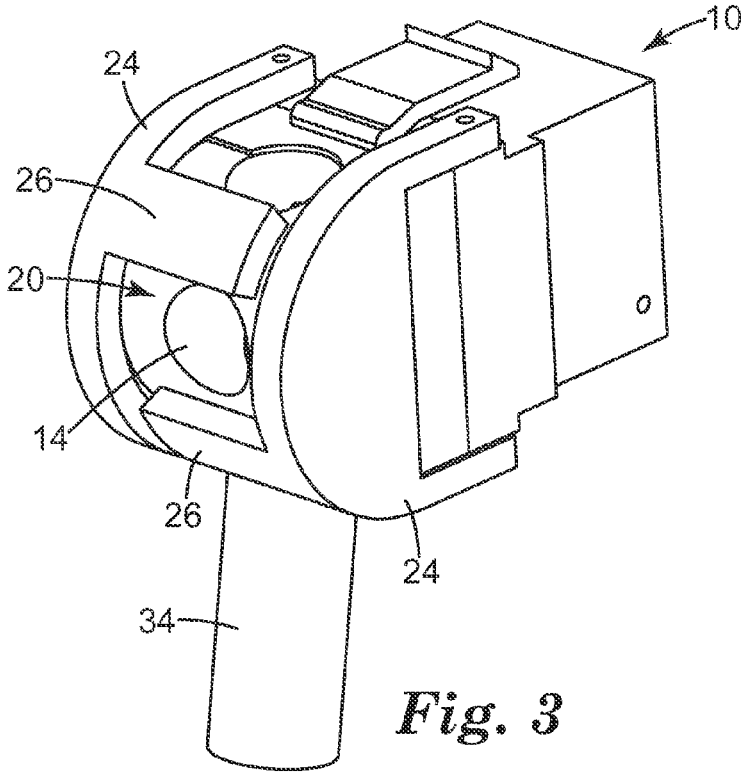
FIG. 3 shows the connector of FIG. 1 with a cable connected therewith.

FIG. 3 shows the connector 10 with a cable 34 connected thereto. In the situation shown in FIG. 3, the cable 34 has been inserted from the bottom side, the guide piece 20 has been moved towards the contacts 12 (see FIG. 1) and the pivotable flaps 24 have been pivoted towards each other to accommodate the guide piece 20 between them. During this movement, the projections 26 have served to push the guide piece 20 in the above-described manner. It can be taken from FIG. 3, that versatility of the connector 10 described herein may be advantageous in that the cable 34 could also be inserted from the top or straight from the rear. In that respect, the wire opening 16, which is exposed at the rear side, is arranged between the two projections 26.

Figure 4:
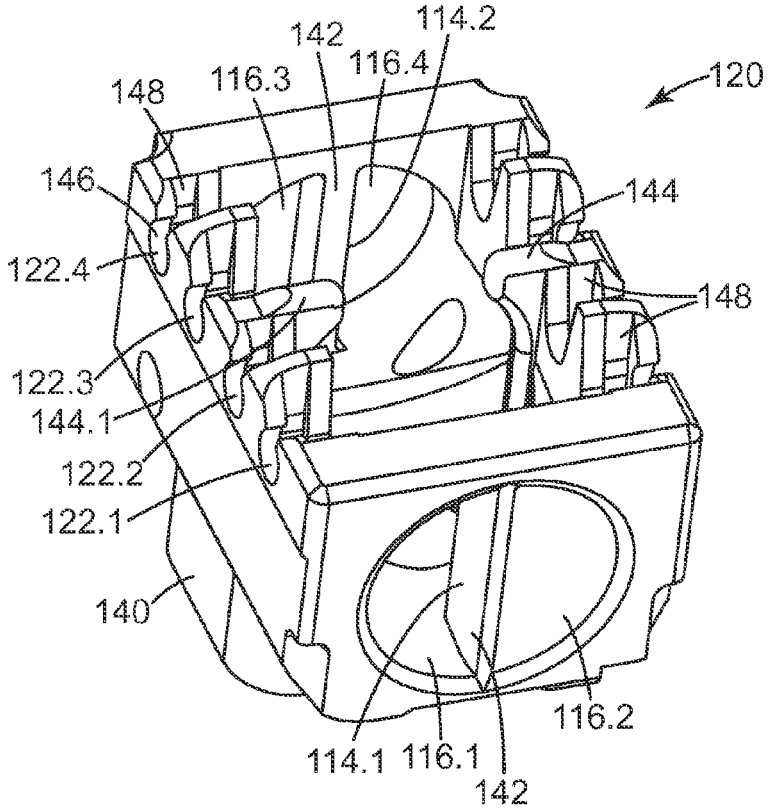
FIG. 4 shows a further embodiment of a guide piece.

FIG. 4 shows a perspective view of another embodiment of a guide piece 120 which may be used in the connector 10 shown in FIGS. 1 and 3 or in another embodiment of a connector. The general appearance of the guide piece 120 differs from that shown in FIG. 2 in that it has the general shape of a cuboid with an elongation 140 that generally corresponds to the thickest part of the semi-cylindrical shape of the guide piece 20 shown in FIG. 2. Similar to the guide piece 20 of FIG. 2, openings 116 are exposed in three different directions. Thus, openings 116 visible in FIG. 4 at the front and rear sides are also formed at the lower side (not visible) of FIG. 4.

It may be taken from FIG. 4 that two openings, 116.1 and 116.2 as well as 116.3 and 116.4 are formed in pairs with a web 142 in between. In the embodiment shown, each opening 116 may, for example, be adapted to accommodate four wires, i.e. two pairs of wires. Thus, the insulation and shielding of a cable (not shown) with which eight wires, i.e. four wire pairs, are integrated, may end at the web 142, and the wires may be inserted through the openings 116, for example, four wires through each opening. That part of the web 142 that extends into the interior of the guide piece 120, denoted 114 in the drawing, may serve as a wire guide. In particular, these wire guides 114.1 and 114.2 formed on opposite sides, may be extended into a partition (not shown) and/or may start at a location somewhat "inside" the guide piece 120, i.e. somewhat displaced towards the centre of the guide piece 120. Thus, wires of a left and right side (as oriented in FIG. 4), may be advantageously separated from each other and guided. In such an embodiment, a web (not shown) formed across the openings (not shown) of extension 140 may be coplanar with the webs 142 visible in FIG. 4.

In the embodiment of FIG. 4, four recesses 122 for accommodating wires, described in more detail below, are formed on each side. Moreover, the embodiment shown has, between the second 122.2 and third recess 122.3, i.e., approximately at the center of each side, an internal lug 144 protruding to the interior of the guide piece 120 and serving to separate those wires from each other, which are inserted into the recesses in front of the lug 144, on the one hand, and into the recesses behind the lug 144, on the other hand. In other words, considering four wires, which may, for example, be inserted through the front and left side opening 116.1, two wires of an upper wire pair may, for example, be inserted into recesses 122.1 and 122.2. The wires of a "lower" wire pair may continue at a location below the left side lug 144.1, to recesses 122.3 and 122.4 and may be inserted into these.

As can be seen in FIG. 4, each recess 122 has an entrance 146 which is somewhat narrower than the remainder of the recess 122. The entrances 146 may also be used to clamp wires accommodated therein. This also applies to the remainder of the recesses 122. Moreover, the recess 122 may have an approximately circular cross-section adapted to accommodate wires having, together with their insulation, an approximately circular cross-section as well. When a wire is inserted into a recess 122, the insulation thereof may be briefly compressed, to allow the wire to pass the narrow entrance 146 and the wire then be accommodated in the recess 122. As can be seen from the recesses 122 on the right side of FIG. 4, the recesses may be formed as generally rounded, V-shaped recesses towards the inside of the guide piece 120. In the embodiment shown, there are, between the outer areas of the recesses 122, having the narrow entrance 146, and the inner, generally V-shaped areas of the recesses 120, slots 148 which serve, as mentioned above, to accommodate the contacts 12 (see FIG. 1) and guide the guide piece 120, when the guide piece 120 is pushed towards the contacts.

Figure 5:
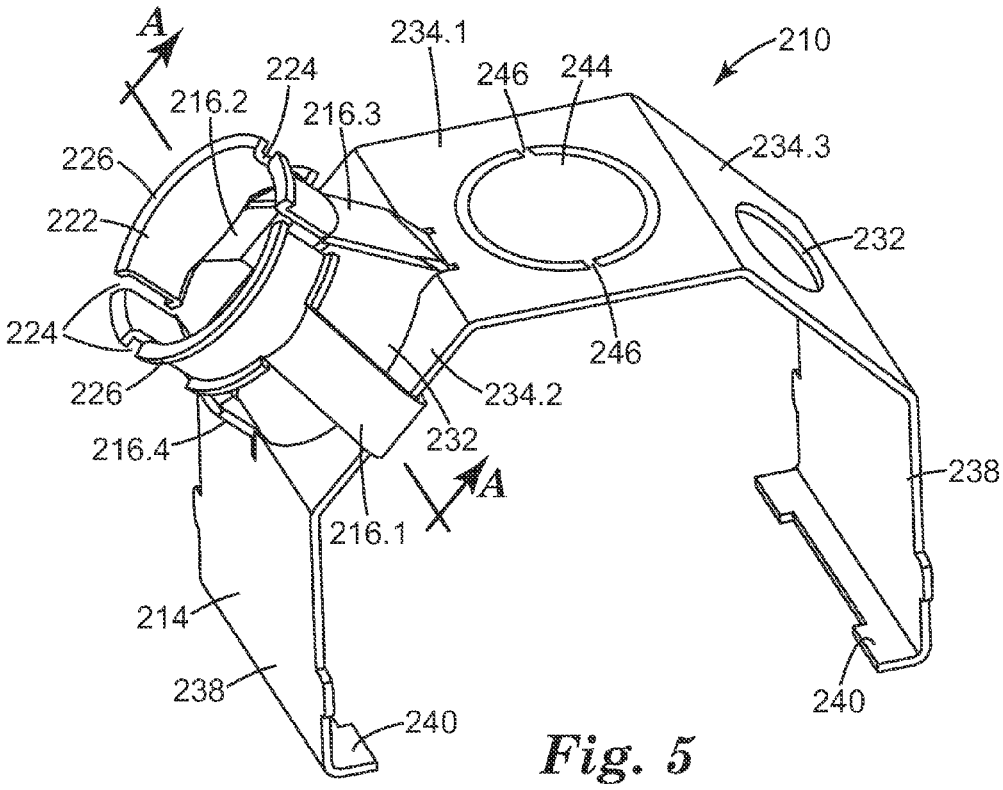
FIG. 5 shows a perspective view of a shielding according to the invention.

FIG. 5 shows the shielding 210 as described herein. The general shape of the shielding 210 may be described to be generally U-shaped with the "U" being shown upside-down in FIG. 5. The U-shape has two substantially parallel side legs 238, a first entry portion 234.1 defining the bottom of the U, and a second 234.2 and third 234.3 entry portion defining inclined transitions between the side legs 238 and the first entry portion 234.1. In the embodiment shown the side legs 238 have lugs 240 which are directed to each other and may be used to mount the shielding 210 to the connector (not shown).

As may be taken from FIG. 5, each entry portion 234 has an entry 232 constituted by an opening. The openings may be formed by removing breakout portions 244 (only shown for the first entry portion 234.1). In the embodiment shown, the breakout portion 244 is connected with the entry portion 234.1 via two narrow ridges 246. In the embodiment shown, plural extensions 216 are mounted to the second entry portion 234.2. It can be taken from FIG. 5 that the third entry portion 234.3 is substantially symmetrical to the second entry portion 234.2 about a vertical axis (according to the orientation of FIG. 5), in other words about the centre of the first entry portion 234.1. Thus, the third entry portion 234.3 could be omitted and the shielding 210 as a whole could be oriented in a suitable manner to bring the extension 216 to that part of the connector described above, at which the cable is to be inserted.

In the embodiment shown, a front extension 216.1 and rear extension 216.2 have an integral ring segment covering an angle of approximately 120 degrees. The remaining extensions, in FIG. 5 the right 216.3 and left extension 216.4, are formed cylindrical at their free ends so as to constitute ring segments 222. The ring segments 222 cooperate to define a substantially complete ring having interruptions 224. A cable tie (not shown) or a similar part may be laid around this ring constituted by the ring segments 222 to tie same around the cable shielding of the cable (not shown). The interruptions 224 may be substantially closed, when the extension 216 has been tied around a cable shielding, to provide a contact of substantially 360 degrees around the cable shielding. In the embodiment shown, the ring segments 222 have, both at their bottom and their top, annular webs 226 protruding outwards which serve to position a cable tie or a similar component. Moreover, one or more extensions 216 may have lateral projections extending towards an adjacent extension to provide a "closed" ring and achieve low impedance when a cable tie or similar element is tied.

Figure 6:
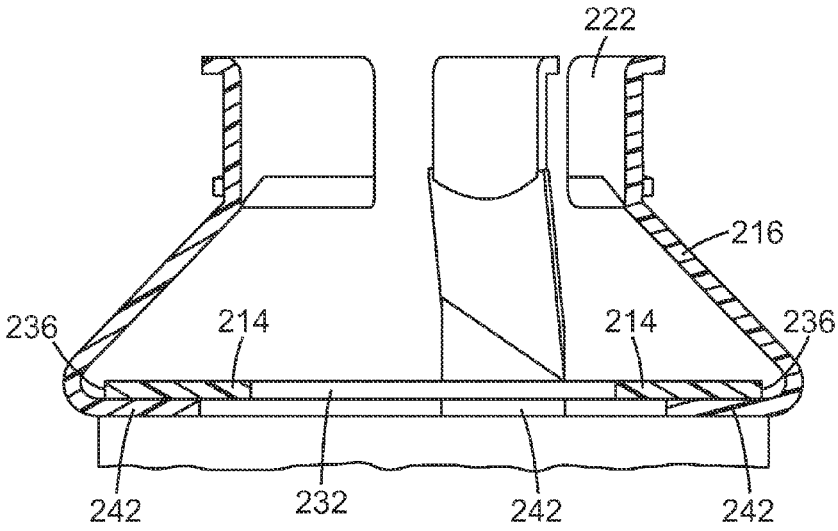
FIG. 6 shows a sectional view through section A-A of FIG. 5.

FIG. 6 shows, by section A-A of FIG. 5, how at least one extension 216 may be mounted to the connector shielding 214. In an area substantially opposite the ring segment 222 of extension 216, a section 242 of the extension 216 may be bent around an edge 236 of the connector shielding 214. This may be done at opposite sides of the connector shielding 214, as shown in FIG. 6, to secure the at least one extension in this position. Stability may be improved if, unlike shown in FIG. 5, two substantially opposite extensions, such as front 216.1 and rear extensions 216.2 are connected through a relatively long ring segment or a ring, which is almost complete. In this case, both extensions may be bent around the respective edge of the connector shielding 214.

Figure 7:
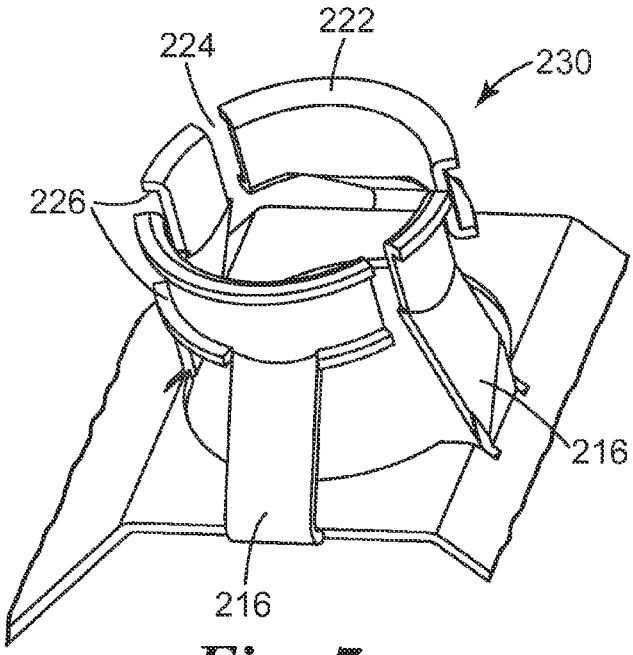
FIG. 7 shows a part of the shielding of FIG. 5.

FIG. 7 shows a different embodiment having a component which can be called an extension piece 230 with which all extensions 216 are integrated. The remaining structures including ring segments 222 with interruptions 224 in between, and webs 226 being formed along the ring segments, is substantially the same as shown in FIG. 5. The extension piece 230 of FIG. 7 may be mountable to the connector shielding 214. For this purpose, the extension piece 230 may have sections which are bendable around one or more edges of the connector shielding. As an alternative, the extension piece 230 may be pre-mounted to the connector shielding and slidable along the connector shielding to bring it to the appropriate location. The extension piece 230 of FIG. 7 as well as extensions 316 of FIGS. 9 to 11, which are attachable to a shielding, are to be considered independent subject matter of the present disclosure.

Figure 8:
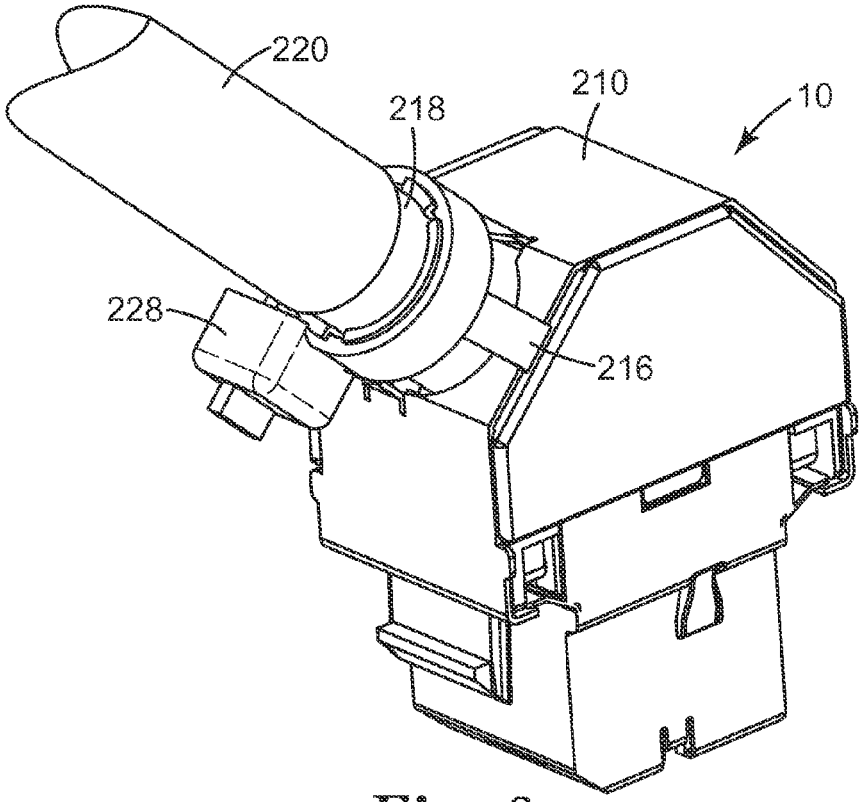
FIG. 8 shows a shielding attached to a connector.

FIG. 8 shows a connector 10, which could be the connector of FIGS. 1 and 3, with a shielding 210 mounted thereto. A cable 220 having a cable shielding 218 has been inserted through the plural extensions 216 and into the connector 10. The wires of the cable 220 have been connected with contacts (not shown) of the connector 10, and a cable tie 228 has been used to tie the extensions 216, particularly the ring sections thereof, to the cable shielding 218. In this manner, shielding 210 of the connector 10 and contact between the shielding 210 and the cable shielding 218 can be realized.

Figure 9:
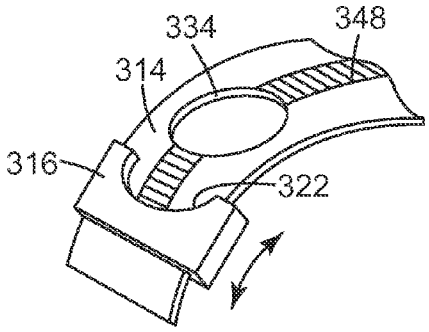
FIG. 9 shows a schematic drawing of a further embodiment of a shielding according to the invention.

FIG. 9 shows a further embodiment of a connector shielding 314 having an entry portion 334. Moreover, schematically shown, an extension 316 is provided which is displaceable along the connector shielding 314. As indicated in FIG. 9, the extension 316 may have a half ring segment 322 to contact approximately 180 degrees of cable shielding (not shown). In the embodiment shown, the connector shielding 314 has plural engagement portions 348 formed in a kind of railway-track. The engagement portions may, for example, be projections or recesses.

Figure 10:
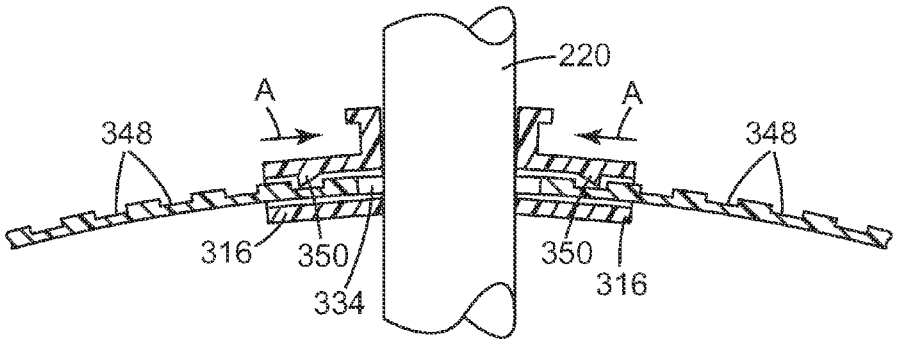
FIG. 10 shows a detailed cut view of the embodiment of FIG. 9.

As shown in FIG. 10, extensions 316 may have one or more engagement members 350 engageable with engagement portions 348 of the connector shielding 314. Extensions 316 may be moved in direction A, i.e. towards each other and towards a cable 220. However, the engagement members 350 may be shaped to block displacement in the opposite direction. Thus, the extensions 316 may be reliably kept near cable 220 and may additionally be tied thereto by a cable tie (not shown).

Figure 11:
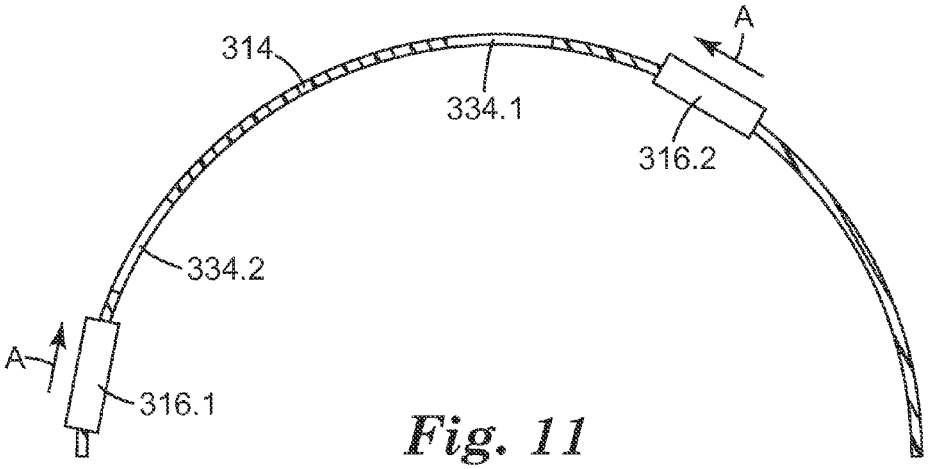
FIG. 11 shows a schematic side view of the embodiment of FIGS. 9 and 10.

FIG. 11 additionally shows the possibility of displacing extensions 316 towards each other and to an appropriate entry portion 334. In particular, FIG. 11 may show an initial state, in which a first extension 316.1 is positioned near a first end of the connector shielding 314, and a second extension 316.2 is positioned between approximately the centre of the connector shielding 316 and the other end thereof. When a cable is to be inserted in an approximately centred position, both extensions 316 are moved to the centre entry portion 334.1. When a cable is to be inserted through one of the sides, both extensions 316 are moved towards the second entry portion 334.2, formed near the first end. Afterwards, the shielding may be rotated for approximately 180 degrees about the centre entry portion 334.1, i.e. about a vertical axis of FIG. 11, to allow a cable to be inserted from the right side of FIG. 11.

Figure 12:
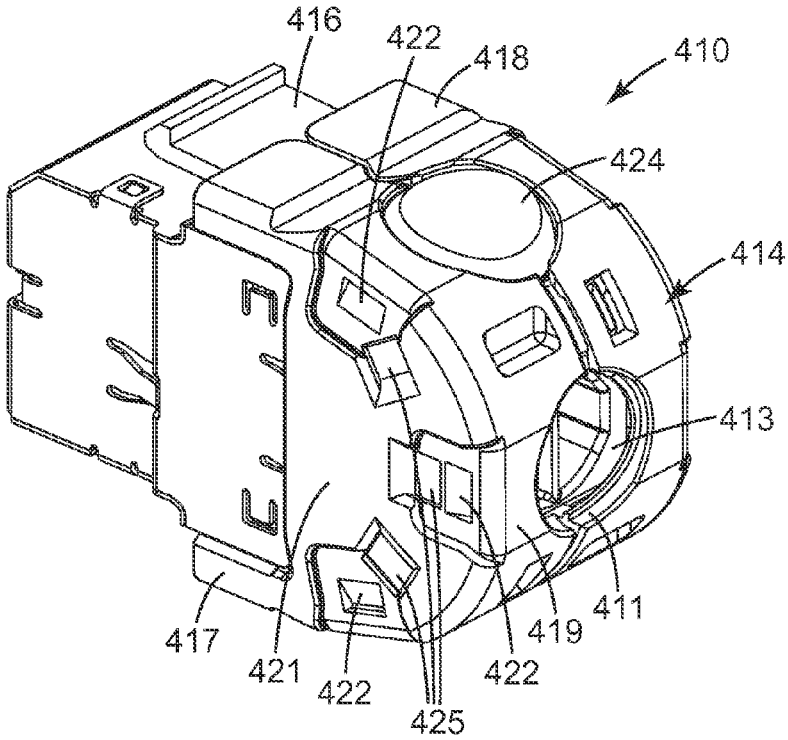
FIG. 12 shows a perspective view of a further embodiment of a connector according to the invention.

FIG. 12 shows a further embodiment of a connector 410 according to the invention from a rear view (i.e. from the side where the cable enters the connector 410). The side, where a cable (not shown) is inserted into the connector 410, for example through an opening 411, is facing the viewer of FIG. 12. Therefore, the generally opposite side, where a complementary connector or plug may be inserted, is not visible in FIG. 12. The connector 410 comprises a housing 412 with contacts to allow the contacts of the plug to be electrically contacted. The housing 410 of the embodiment shown in FIG. 12 resembles the housing 18 of the embodiment shown in FIG. 1. It also has latch hooks 416 or similar structures to allow mounting the connector 410 to an appropriate surrounding. The contacts inside of the housing (not shown) may be isolation displacement contacts. Furthermore the connector 410 comprises a guide piece 413, that can partially be seen through the opening 411 also resemble the guide piece 20 of the embodiment of FIG. 1.

The connector 410 shown in FIG. 12 has two drive pieces in the form of pivotable flaps 414. The flaps 414 will be described in detail with reference to FIGS. 13*a* to 13*e*. When a cable has been inserted into the guide piece 413, the guide piece 413 may be placed in close proximity to the contacts 12, the pivotable flaps 414 may be pivoted towards the guide piece 413 and may engage with the guide piece 413 to push it towards the contacts when the pivotable flaps 414 are approaching their final position shown in FIG. 12. Generally, the pivotable flaps 414 may be pivotable about an axis perpendicular to the direction in which the guide piece 413 is to be moved. In the embodiment shown in FIG. 12 a swivel axis of the pivotable flaps 414 is placed at an outer edge of side legs 417, 418.

The pivotable flaps 414 and 414 of the embodiment of FIG. 12 are made out of electrically conductive material and therefore can fulfil the function of a shielding as well as the function of pushing or driving the guide piece 413 into its final position. The two flaps 414 completely cover the rear side of the connector 410 in the closed position that is shown in FIG. 12. FIG. 12 shows the connector 410 without a cable but with a guide piece 413 that has been moved towards the contacts (not shown) and the pivotable shielding flaps 414 that have been pivoted towards each other into their closed position to accommodate the guide piece 413 between them. During this movement projections 423 (see FIG. 13) serve to push the guide piece 413 in the above-described manner.

The shielding flaps 414 may be described to be generally U-shaped with the opening of the U showing into the direction of the front side of the connector 410. The U-shape has two substantially parallel side legs 417 and 418. The swivel axis is located at the end of the legs 417 and 418 showing into the direction of the front side of the connector 410. The legs 417 and 418 are connected with each other through a curved portion 419 and in the area of this curved portions 419 the shielding flaps 414 further comprise a side wall 421. The two shielding flaps 414 are more or less symmetrical with respect to an upright plane dividing the connector 410 into two halves.

The shielding flaps 414 have entry portions constituted by an opening 411. The opening 411 may be formed by removing breakout portions 424. In the embodiment shown in FIG. 12, the breakout portion 424 of the rear entry is removed so that the guide piece 413 can be seen and the breakout portion 424 of the upper entry is still in its initial place. A third entry portion on the bottom side can not be seen in FIG. 12 but it can be substantially symmetrical to the upper entry portion. Thus, the third entry portion could be omitted and the shielding flaps 414 or the whole connector 410 could be oriented in a suitable manner so that a cable can be inserted.

The shielding flaps 414 further comprise recesses 422 for complementary structures at an extension 431 that will be described in detail with reference to FIG. 14. The recesses 422 are located at each side wall 421 of the shielding flaps 414 adjacent the entry portions of the connector 410, that means that there are recesses 422 at the side wall 421 of each shielding flap 414 adjacent the rear entry portion, recesses 422 adjacent the upper entry portion and recesses 422 adjacent the bottom entry portion. Next to the recesses 422 there may be an insertion area, for example in the shape of a ramp 425, to allow a tool, for example a screw-driver, to be inserted and to remove the complementary structures at the extension 431. This may be the case if the cable was wrongly terminated or a cable has to be changed.

The shielding flaps 414 may be moulded out of Zamac, an aluminium based material. The breakout portions 424 are moulded at the same time. They can easily be removed because of a very thin border between the breakout portion 424 and the flap 414 itself. The breakout portions 424 may be located in one flap 414 at a location where the other flap 414 has an opening. The breakout portions 424 may also be located in both flaps 414 so that two breakout portions have to be removed when a cable is mounted to the connector 410. The breakout portions 424 may all be positioned in one flap 414 or they may be integrated in both flaps 414.

Figure 13A:
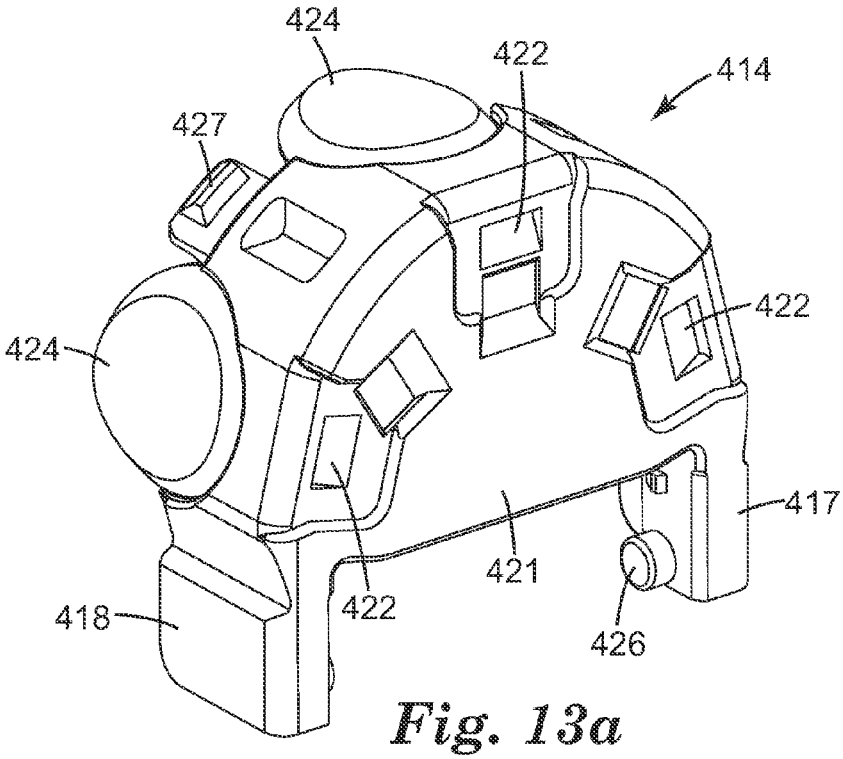
FIGS. 13*a* to 13*e* show perspective views of shielding flaps of the connector of FIG. 12.
Figure 13B:
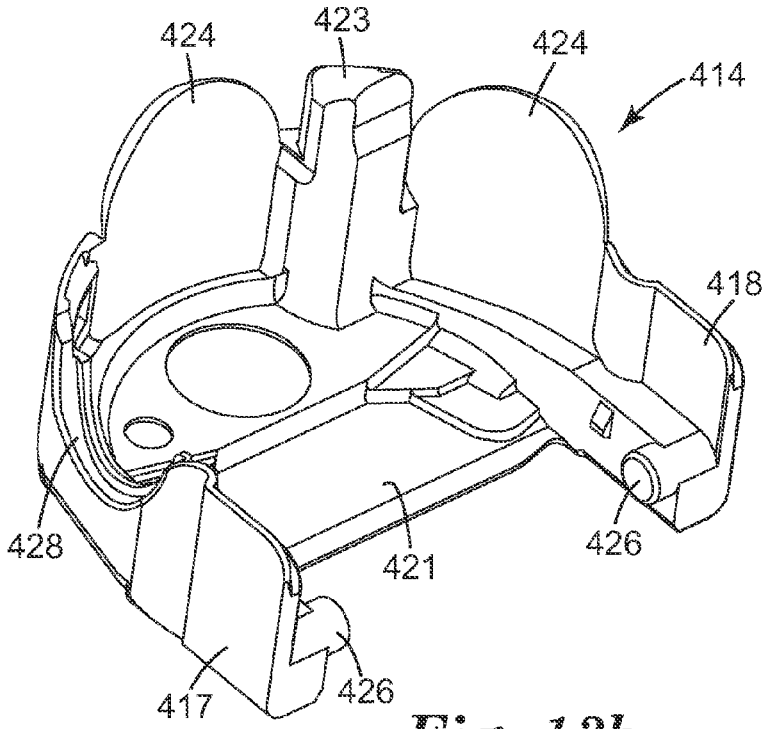

FIG. 13*a* to FIG. 13*e* show perspective views of the shielding flaps 414. FIG. 13*a* and FIG. 13*b* show perspective views of a first shielding flap 414. FIG. 13*a* shows a side view and FIG. 13*b* shows an inner view. FIG. 13*b* shows that side of the shielding flap 414 that faces—in an assembled stage of the connector 410—the housing 412 and the guide piece 413 of the connector 410. As can be seen the shielding flap 414 comprises a protrusion 426 at the end of each leg 417, 418 facing inside of the U shape and cooperating in an assembled stage with holes or cuts in the housing 412 and thereby providing the possibility of swivelling the shielding flaps 414 around the protrusions 426. The flaps 414 further comprise projections 423 for forcing or guiding the guide piece 413 into its end position—as described above in connection with the embodiment shown in FIG. 1. The projections 423 are located at the curved portion 419 of the shielding flaps 414. The projections 423 itself provide at their ends a nose 427 facing to the outside and cooperating with a deepening or dent (not shown) in the corresponding flap 414 for fixing the two flaps 414 by snap-fit with each other in their closed position.

Figure 13C:
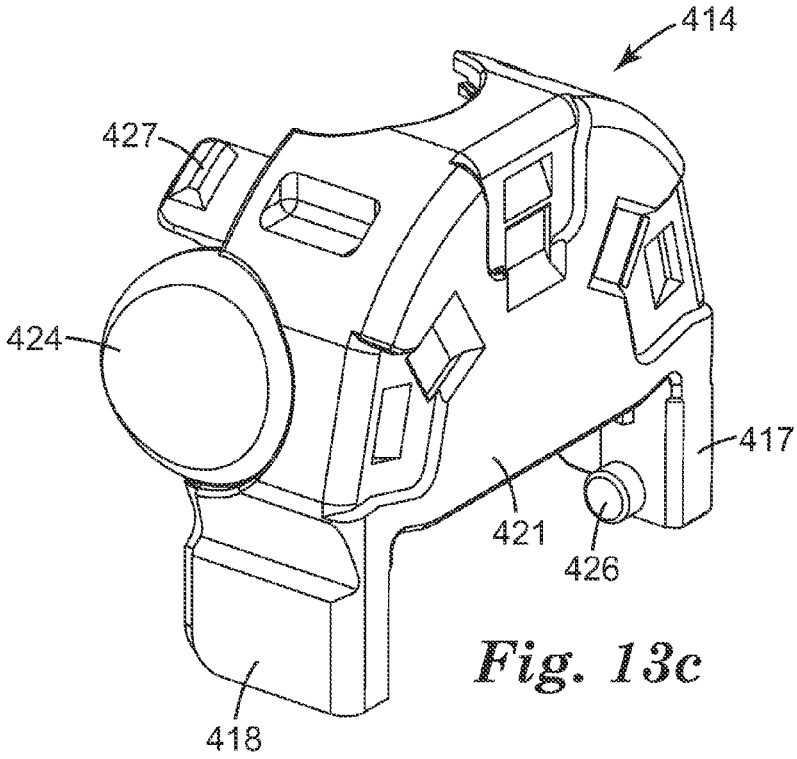
Figure 13D:
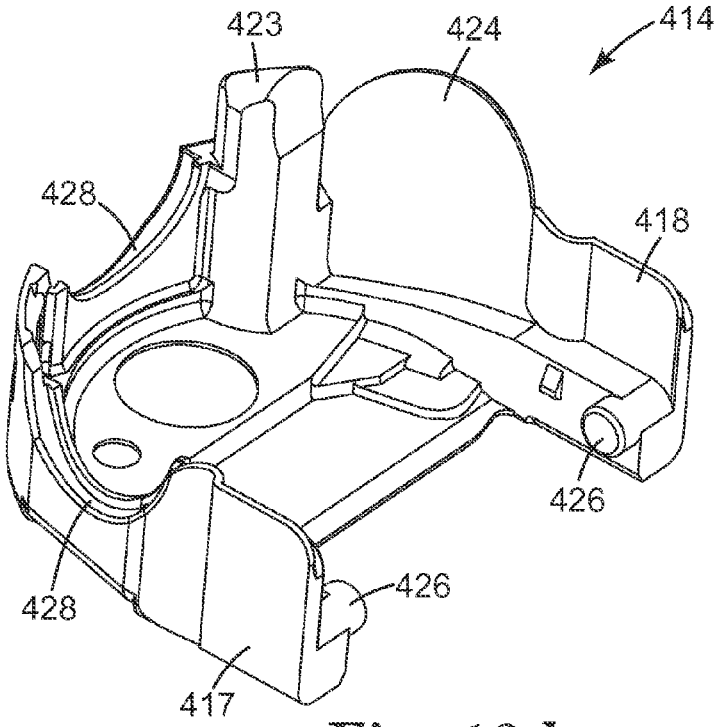

The shielding flap 414 of FIG. 13*a* and FIG. 13*b* does have two breakout portions 424 and one rounded passage 428 all located in the curved portion 419 of the shielding flap 414 facing into the direction of the second flap (in the assembled stage). At the side wall 421 of the shielding flap 414 can be seen the recesses 422 and the ramps 425 adjacent to the breakout portions 424 and the rounded passage 428. The shielding flap 414 of FIG. 13*c* and FIG. 13*d* does have the same features as the shielding flap 414 of the FIG. 13*a* and FIG. 13*b* except that the shielding flap 414 of the FIG. 13*c* and FIG. 13*d* does only have one breakout portion 424 and two rounded passages 428. In the assembled stage the two breakout portions 424 of the first shielding flap 414 (FIGS. 13*a* and 13*b*) are located next to the rounded passages 428 of the second shielding flap 414 (FIG. 13*c* and 13*d*) and the one breakout portion 424 of the first breakout portion 414 (FIGS. 13*a* and 13*b*) is located next to the rounded passage 428 of the second shielding flap 414 (FIGS. 13*c* and 13*d*). By this only one breakout portion 424 has to be removed when a cable is mounted to the connector 410.

Figure 13E:
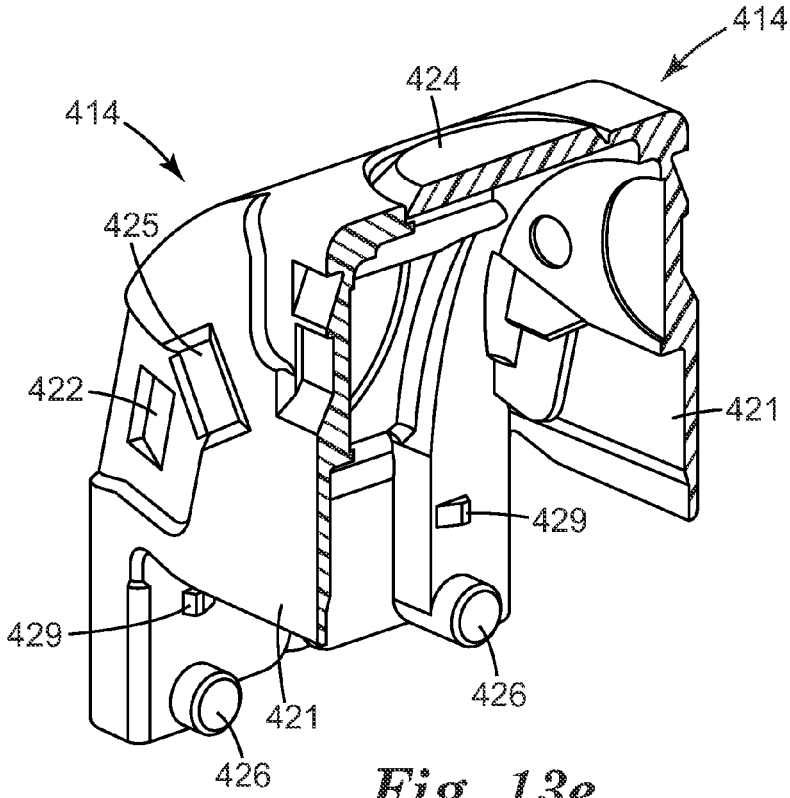

FIG. 13*e* shows a sectional view of the two shielding flaps 414 in an assembled and closed stage. It can be seen that the two flaps 414 overlap each other thereby avoiding a gap between them to provide a good and equal shielding. Inside of the two flaps 414 can be seen further fixing or locking elements in the shape of little edges 429. Those edges 429 cooperate with corresponding locking means in the housing (not shown) and help to fix the flaps 414 relative to the housing in a closed position. FIG. 13*e* further shows that the breakout portion 424 of the rearmost flap 414 lies adjacent the curved portion 419 of the front flap 414.

Figure 14:
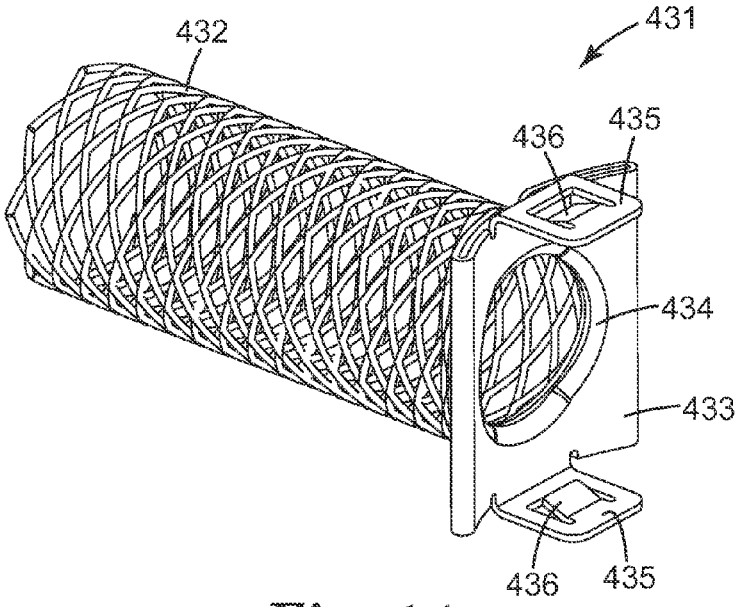
FIG. 14 shows a perspective view of an extension of the connector of FIG. 12.

FIG. 14 does show the extension 431 of the embodiment of the connector of FIG. 12. The extension 431 comprises a cylindrical braid 432 and a mounting plate 433. The braid 432 may be flexible thereby allowing the cable to be bend. The mounting plate 433 has a round opening 434. The cylindrical braid 432 is fixed around the round opening 434 in such a way that a cable that is mounted to the connector 410 can go through the braid 432 and the opening 434 of the mounting plate 433. The mounting plate 433 has a rectangular shape and is curved with approximately the same radius than the curved portion 419 of the shielding flaps 414. At two opposite sides of the mounting plate 433 that are rectangular to the bend radius are located two legs 435 with latches 436. Those latches 436 cooperate with the recesses 422 in the side walls 421 of the shielding flaps 414 and function as fixing means for the extension 431 at the connector 410. The latches 436 together with the legs 435 are resilient and may be snap fitted to the shielding flaps 414. They may be released from the shielding flaps 414 by using a tool as described above.

Figure 15:
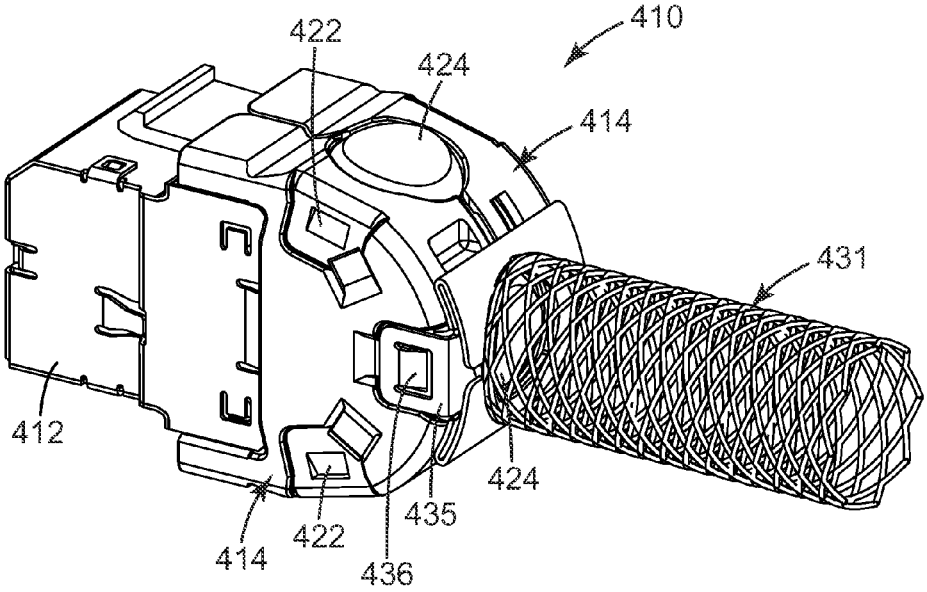
FIG. 15 show perspective views of the connector of FIG. 12 with the extension of FIG. 14
Figure 16:
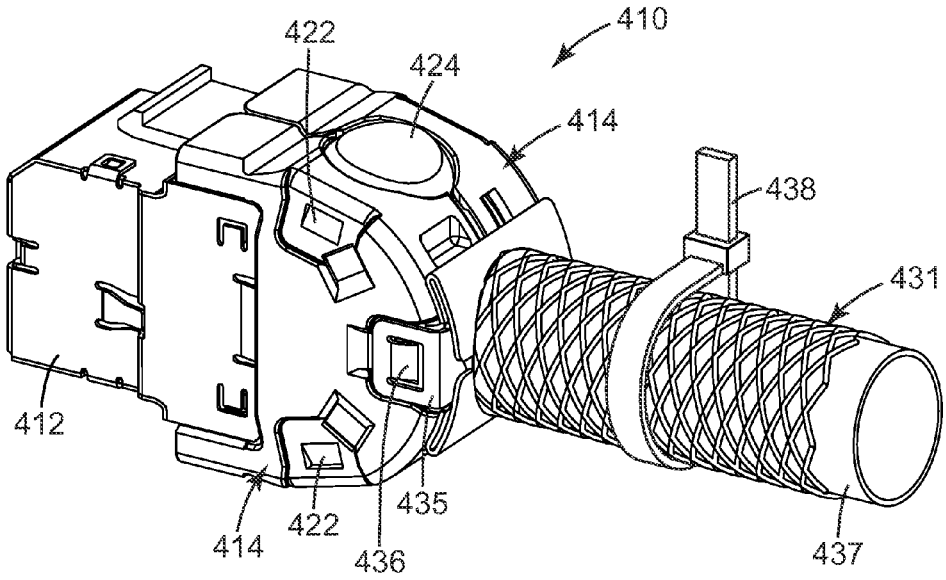
FIG. 16 shows a perspective view of the connector of FIG. 12 with the extension of FIG. 14 and a cable tie.

FIG. 15 shows the extension 431 mounted to the connector 410 at its rear side. The breakout portion 424 has not yet been removed. It can be seen that the latches 436 of the legs 435 engage with the recesses 422 of the flaps 414 and thereby fix the extension 431 to the connector 410. FIG. 15 shows the extension 431 being fixed at the rear side of the connector. FIG. 16 differs from FIG. 15 in that FIG. 16 additionally shows a cable 437 that is mounted to the connector 410. The cables 437 goes through braid 432 of the extension 431 and through the rear opening of the connector 410 into the connector 410. The wires of the cable 437 have been connected with contacts (not shown) of the connector 410, and a cable tie 438 has been used to tie the extension 431 to the cable. In that manner, shielding of the connector 410 and contact between the shielding 210 and the cable shielding can be realized.

The extension 431 may also be fixed to the connector and/or the shielding by fixing means that extend inside the connector or the shielding, e.g. the flaps that form the shielding. It is further possible to fix the extension pivotable to the connector and/or the shielding thereby having the possibility to swivel the extension from one position to the other. In this embodiment it would be necessary to have additional means for securing the extension in its desired position. Another possibility would be to clamp the extension between the two shielding flaps.

The present invention has now been described with reference to embodiments thereof. The foregoing detailed description and embodiment have been given for clarity of understanding only. No unnecessary limitations are to be understood there from. For example, all references to sides and directions are exemplary only and do not limit the claimed invention. It will be apparent to those skilled in the art that many changes can be made to the embodiment described without departing from the scope of the invention. Thus, the scope of the present invention should not be limited to the exact details and structures described herein, but rather by the structures described by the language of the claims and the equivalents of those structures.

The invention claimed is:

1. A connector in the field of telecommunications comprising:

a housing, a plurality of contacts disposed within the housing and with which wires are connectable inside the connector, a guide piece having a plurality of wire openings disposed on the rear side of the housing, and a connector shielding attached to a rear side of a connector having an entry portion aligned with one of the wire openings in the guide piece and an extension mounted over said entry portion that is connectable with a cable shielding of a cable, wherein the connector has at least three wire openings, each wire opening being adapted to accommodate at least two wires and exposed on an outside of the connector distal from the contacts, the wire openings being exposed in at least three different directions.

2. The shielding in accordance with claim 1, wherein the at least one extension is bent around at least one edge of the shielding of the connector.

3. The shielding in accordance with claim 1 having the at least two entry portions arranged asymmetrically.

4. The shielding in accordance with claim 1, wherein the at least one extension includes one of a ring or a ring segment.

5. The shielding in accordance with claim 4, wherein the at least one extension has at least one web formed across the extension and the ring or ring segment.

6. The shielding in accordance with claim 1, wherein the at least one extension is resilient with regard to the shielding of the connector.

7. The connector in accordance with claim 1, wherein the wire openings are arranged in pairs or groups of four, the wire openings of one pair or group being exposed in the same direction.

8. The connector in accordance with claim 1, wherein at least one guide is formed adjacent at least one wire opening.

9. A connector in the field of telecommunications comprising:

a housing, a plurality of contacts disposed within the housing and with which wires are connectable inside the connector, a guide piece having a plurality of wire openings disposed on the rear side of the housing, and a connector shielding attached to a rear side of a connector having an entry portion aligned with one of the wire openings in the guide piece and an extension mounted over said entry portion that is connectable with a cable shielding of a cable, wherein the guide piece has at least one recess for accommodating at least one wire, the recess facing the contacts and wherein the housing is provided with at least one drive piece adapted to drive the guide piece towards the contacts.

10. The connector in accordance with claim 9, wherein the drive piece is a pivotable flap having at least one projection adapted to drive the guide piece when the flap is pivoted.

11. The connector in accordance with claim 10, wherein at least two projections are provided, and at least one wire opening is located between two projections.

12. The connector in accordance with claim 9, wherein the pivotable flaps are the connector shielding.

13. The shielding in accordance with claim 9, wherein the at least one extension is bent around at least one edge of the shielding of the connector.

14. The shielding in accordance with claim 9 having the at least two entry portions arranged asymmetrically.

15. The shielding in accordance with claim 9, wherein the at least one extension includes one of a ring or a ring segment.

16. The shielding in accordance with claim 15, wherein the at least one extension has at least one web formed across the extension and the ring or ring segment.

17. The shielding in accordance with claim 9, wherein the at least one extension is resilient with regard to the shielding of the connector.

* * * * *

UNITED STATES PATENT AND TRADEMARK OFFICE

CERTIFICATE OF CORRECTION

PATENT NO. : 8,376,779 B2
APPLICATION NO. : 12/680954
DATED : February 19, 2013
INVENTOR(S) : Guy Metral It is certified that error appears in the above-identified patent and that said Letters Patent is hereby corrected as shown below:

In the Specifications:

Column 2,
Line 50, after "which" insert -- : --.

Column 3,
Line 10, after "14" insert -- ; --.

Column 10,
Line 40, delete "preformed" and insert in place thereof -- performed --.

Column 17,
Line 32, delete "FIG." and insert in place thereof -- FIGS. --.

Signed and Sealed this
Second Day of July, 2013

Teresa Stanek Rea
*Acting Director of the United States Patent and Trademark Office*